US005307597A

United States Patent [19]

Tanikawa et al.

[11] Patent Number: 5,307,597

[45] Date of Patent: May 3, 1994

[54] WATER DEFLECTOR

[75] Inventors: Shinji Tanikawa; Masayoshi Ishikawa, both of Marietta, Ga.

[73] Assignee: YKK Corporation, Lyndhurst, N.J.

[21] Appl. No.: 976,459

[22] Filed: Nov. 13, 1992

[51] Int. Cl.[5] ..... E04D 13/00

[52] U.S. Cl. ..... 52/97; 52/235

[58] Field of Search ..... 52/97, 209, 308, 235, 52/403, 393, 394, 395, 471, 586, 473

[56] References Cited

U.S. PATENT DOCUMENTS

| | | | |
|---|---|---|---|
| 3,320,706 | 5/1967 | Elliott et al. | 52/393 |
| 3,348,351 | 10/1967 | Citarel et al. | 52/403 X |
| 3,359,022 | 12/1967 | Russell | 52/586 X |
| 3,363,383 | 1/1968 | LaBarge | 52/573 X |
| 3,605,368 | 9/1971 | LaLouche | 52/471 X |
| 3,688,460 | 9/1972 | Van Loghem et al. | 52/471 |
| 3,782,064 | 1/1974 | Hubbard et al. . | |
| 3,844,081 | 10/1974 | Berguall et al. | 52/235 |
| 4,017,090 | 4/1977 | Cohen | 52/94 X |
| 4,207,717 | 6/1980 | Hubbard | 52/235 |
| 4,461,131 | 7/1984 | Pressell | 52/395 |
| 4,558,875 | 12/1985 | Yamaji et al. | 52/169.14 |
| 4,841,700 | 6/1989 | Mattews . | |
| 4,905,435 | 3/1990 | Horst | 52/235 |
| 5,036,637 | 8/1991 | Biebuyck | 52/235 |
| 5,058,344 | 10/1991 | Biebuyck | 52/235 |

*Primary Examiner*—Peter M. Cuomo
*Assistant Examiner*—Jerry Redman
*Attorney, Agent, or Firm*—Finnegan, Henderson, Farabow, Garrett & Dunner

[57] ABSTRACT

An improved WATER DEFLECTOR is fitted into a glazing pocket of the vertical frame member so as to fully extend between the opposed marginal faces and be coplanar with the opposed marginal faces of the vertical frame member. When a horizontal frame member is assembled with the vertical frame member, the water deflector and the opposed marginal faces of the vertical frame member fully seal off the hollow horizontal frame member, the water deflector never interfering with the assembling operation.

8 Claims, 7 Drawing Sheets

WATER DEFLECTOR

BACKGROUND OF THE INVENTION

1. Field of the Invention

The present invention relates to a water deflector mounted at a joint between a horizontal frame member and a vertical frame member of a wall framing for storefronts, and the like.

2. Description of the Related Art

A typical example of water deflector of the type concerned is described in U.S. Pat. No. 3,782,064 and is again indicated by Reference Numeral 301 in phantom lines in FIG. 8 of the drawings appended hereto. The conventional water deflector 301 comprises a resilient U-shaped plate-like deflector body 303 including a pair of upper and lower wings, the upper wing terminating in a slant tail 305 directed slantingly downward. The U-shaped deflector body 303 of the water deflector 301 is snap fit into the a hollow horizontal frame member 307 with its bent directed forward as indicated by a dotted-dash arrow. When the deflector body 303 of the water deflector 301 is resiliently retained there as shown in partly solid and partly broken lines in the same figure, the slant tail 305 of the water deflector 301 protrudes beyond the end of the horizontal frame member 307. Subsequently, a vertical frame member (not shown) is fastened on its side perpendicularly to the end of the horizontal frame member 307 with the glazing pocket of the former aligned with the glazing pocket 309 of the latter. When the vertical frame member is fastened to the horizontal frame member 307, the slant tail 305 of the water deflector 301 projects into the glazing pocket of the vertical frame member. With such construction, rain infiltrated into the glazing pocket 309 of the horizontal frame member 307 flows along the slant tail 305 of the water deflector 301, down the inner wall of the vertical frame member and eventually drains through a weep hole formed in the bottom of the vertical frame member.

This conventional water deflector 301 is satisfactory to some extent but suffers the following disadvantages.

Since the water deflector 301 does not completely seal off the hollow horizontal frame member 307; part of rain flowing down the upper surface of the slant tail 305 of the water deflector 301 is inclined to swerve through a gasket-fitting channel down to the lower surface thereof and flow back along the lower surface of the slant tail 305 into the hollow horizontal frame member 307. This is more so during heavy down pours.

Furthermore, when installed in the horizontal frame member 307, the conventional water deflector 301 has its slant tail 305 projecting far beyond the end of the horizontal frame member 307. This projecting slant tail 305 of the water deflector 301 constitutes a bar to the operation of attaching the horizontal frame member 307 to the side of the vertical frame member, thus rendering the assemblage of the window framing tedious and time-consuming.

SUMMARY OF THE INVENTION

It is an object of the present invention to provide an improved water deflector which is capable of completely preventing rain infiltrated in a glazing pocket of a horizontal frame member from flowing back into the hollow horizontal frame member and leaking into the interior.

Another object of this invention is to provide an improved water deflector which can be firmly attached to a vertical frame member and which, even after attached to the vertical frame member, never constitutes a bar to the operation of attaching the horizontal frame member to the vertical frame member.

According to the present invention, there is provided an improved wall framing including a vertical frame member having a glazing pocket formed on its inner side so as to be defined between a pair of opposed marginal faces thereof, and a hollow horizontal frame member including a glazing pocket formed on its upper surface, the vertical frame member being joined at its intermediate part with one end of the horizontal frame member with the respective glazing pockets aligned with each other, wherein the improvement comprises: a water deflector fitted into the first-mentioned glazing pocket of the vertical frame member so as to fully extend between the opposed marginal faces and be coplanar with the opposed marginal faces, so that the water deflector and the opposed marginal faces fully seal off the hollow horizontal frame member.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in detail with reference to a preferred embodiment shown in the accompanying drawings.

Figure 1:
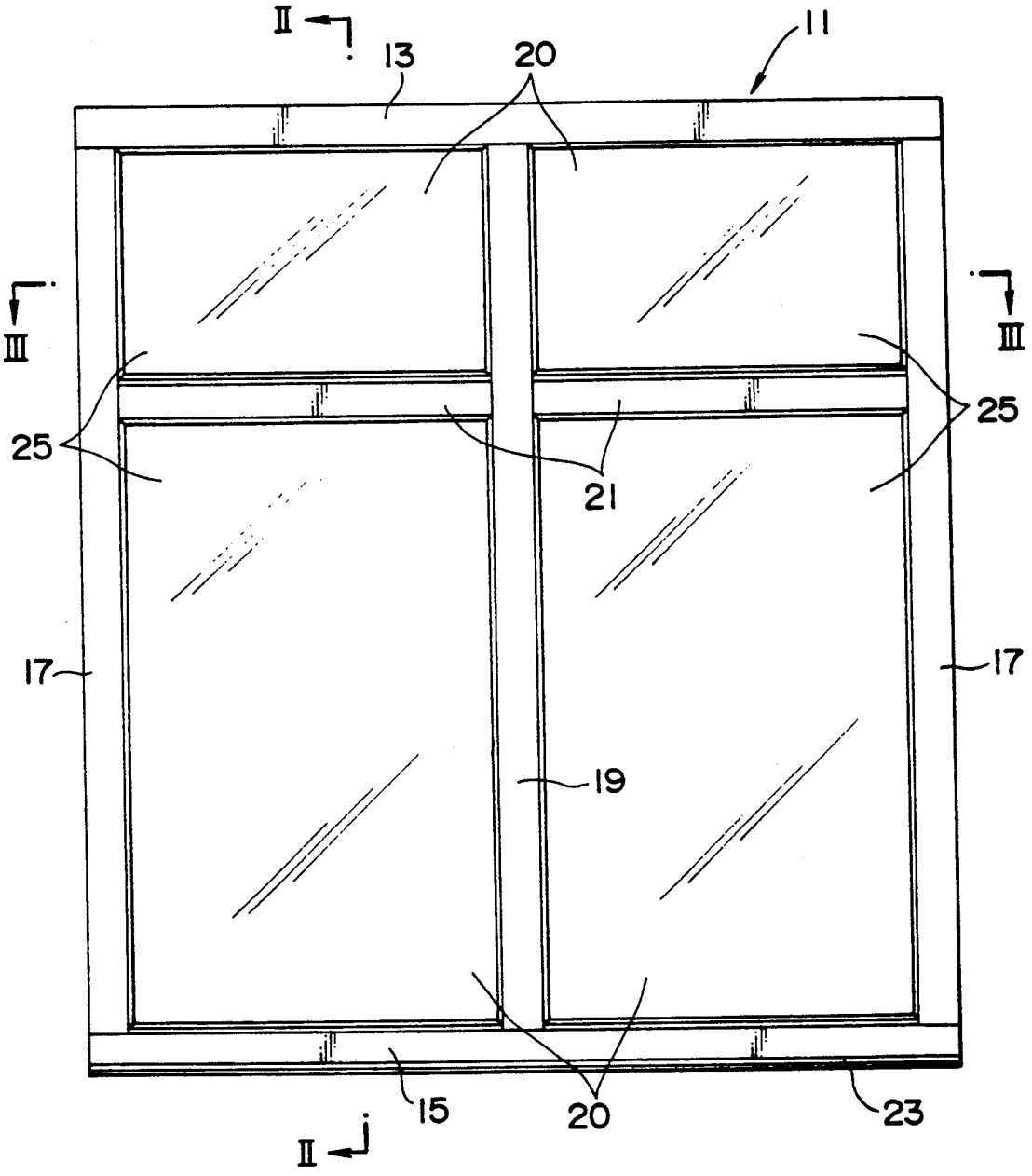
FIG. 1 is a pictorial view of a wall framing wherein a improved water deflector according to the present invention is installed.
Figure 2:
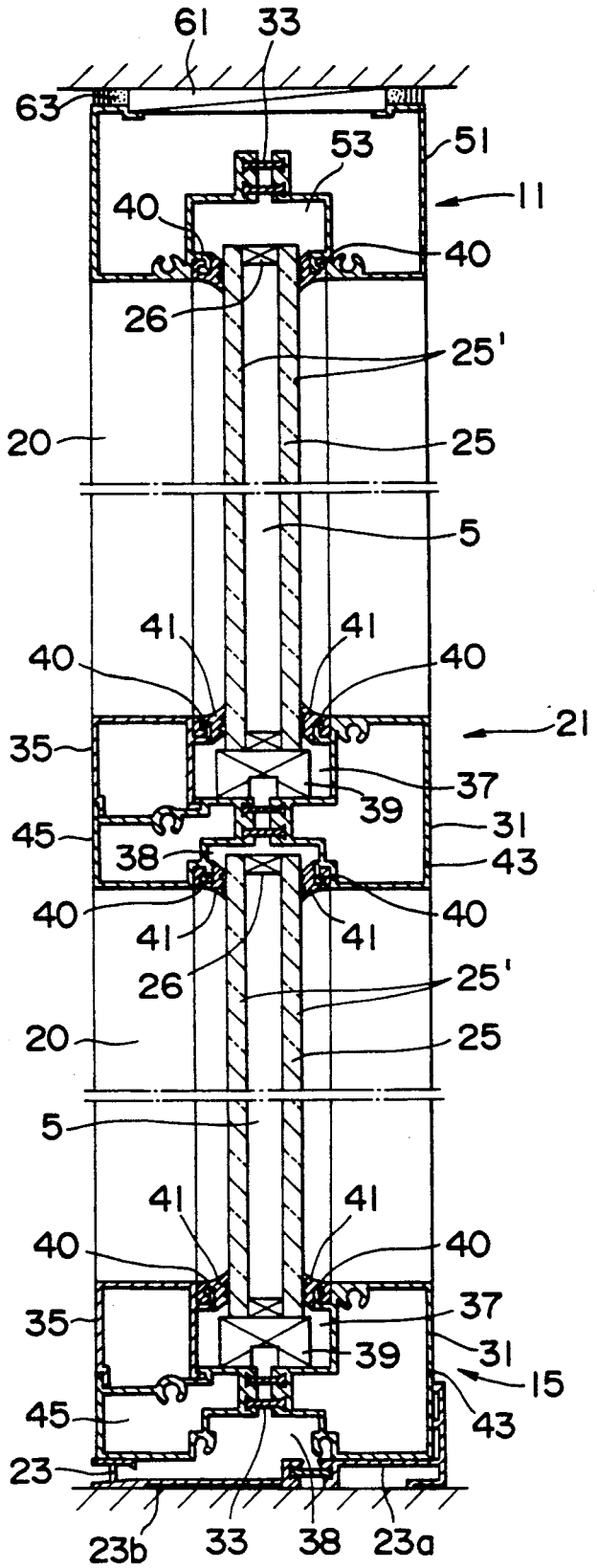
FIG. 2 is a vertical cross-sectional view taken on line II—II of FIG. 1.

FIG. 1 shows a wall framing 11 which broadly comprises a pair of upper and lower horizontal frame members 13, 15 and a pair of vertical frame members 17 joined at their each ends to the ends of the upper and lower horizontal frame members 13, 15, respectively, to thus define a rectangular outline. An intermediate vertical frame member 19 is joined at its opposed ends to the upper and lower horizontal frame members 13, 15 substantially halfway. In addition, a pair of intermediate horizontal frame members 21 are joined at its opposed ends with the intermediate vertical frame member 19 and the respective side vertical frame members 17 at their intermediate positions, with both intermediate horizontal frame members 21 aligned with each other. This arrangement provides four rectangular openings 20, in each of which a dual pane glass panel 25 is fitted. As shown in FIGS. 1 and 2, the lower horizontal frame member 15 is seated on a sill member 23 which in turn rests on a floor of a wall opening (not shown). As shown in FIG. 2, the sill member 23 comprises a substantially L-shaped interior portion 23*a* and a plate-like exterior portion 23*b* joined together with a pour-debridge thermal break 33 interposed therebetween.

As better shown in FIG. 2, the lower horizontal frame member 15 is of a two-piece structure; that is, it comprises a tubular frame member body 31 and a glass stop 35. The tubular frame member body 31 is of an inverted L-shaped cross-section and includes an interior upstanding member 43, and an exterior ledge member 45 joined to each other with a pour-debridge thermal break 33 interposed therebetween. The glass stop 35 is snap fitted onto the upper side of the exterior ledge member 45 to thus define with the interior upstanding member 43 a glazing pocket 37 for receiving the dual pane glass panel 25 therein. A setting block 39 is placed in the glazing pocket 37 and opposed gasket-fitting channels 40 are formed on the opposed upper edges of the interior upstanding member 43 and the glass stop 35, respectively. The dual pane glass panel 25 rests on the setting block 39 in the glazing pocket 37 and is retained by and between gaskets 41 fitted in the opposed gasket-fitting channels 40 of the interior upstanding member 43 and the glass stop 35, respectively. The tubular frame member body 31 has a lower glazing pocket 38 in its lower side.

The dual pane glass panel 25 comprises two panes of glass panels 25' and a spaced strip 26 interposed along its periphery therebetween, thereby providing a thermally insulating air space S within the glass panel 25.

It is to be acknowledged that the intermediate horizontal frame member 21 which is the same in construction as the lower horizontal frame member 15 except that a lower glazing pocket 38 formed in the lower side of the tubular frame member body 31 receives the upper edge of the dual pane glass panel 25 therein. A pair of opposed gasket-fitting channels 40 are formed along the opposed lower edges of the interior upstanding member 43 and the exterior ledge member 45, respectively, of the tubular frame member body 31. In the upper glazing pocket 37, a setting block 39 is placed and a dual pane glass panel 25 rests on the setting block 39.

An upper horizontal frame member 11 comprises an extruded channel profile 51 of a generally C-shaped cross-section. The channel profile 51 has a glazing pocket 53 formed therein for receiving the upper edge of the dual panel glass panel 25. The channel profile 51 is provided in the glazing pocket 53 with a pour-debridge thermally break 33 so as to be thermal broken. The upper horizontal frame member 11 extends along the ceiling (not shown) with a shim 61 and a calking 63 interposed therebetween. A pair of opposed gasket-fitting channels 40 are formed along the opposed longitudinal edges of the glazing pocket 53.

The pour-debridge thermal break 33 is made of synthetic resin which is thermally insulating and relatively rigid.

Figure 3:
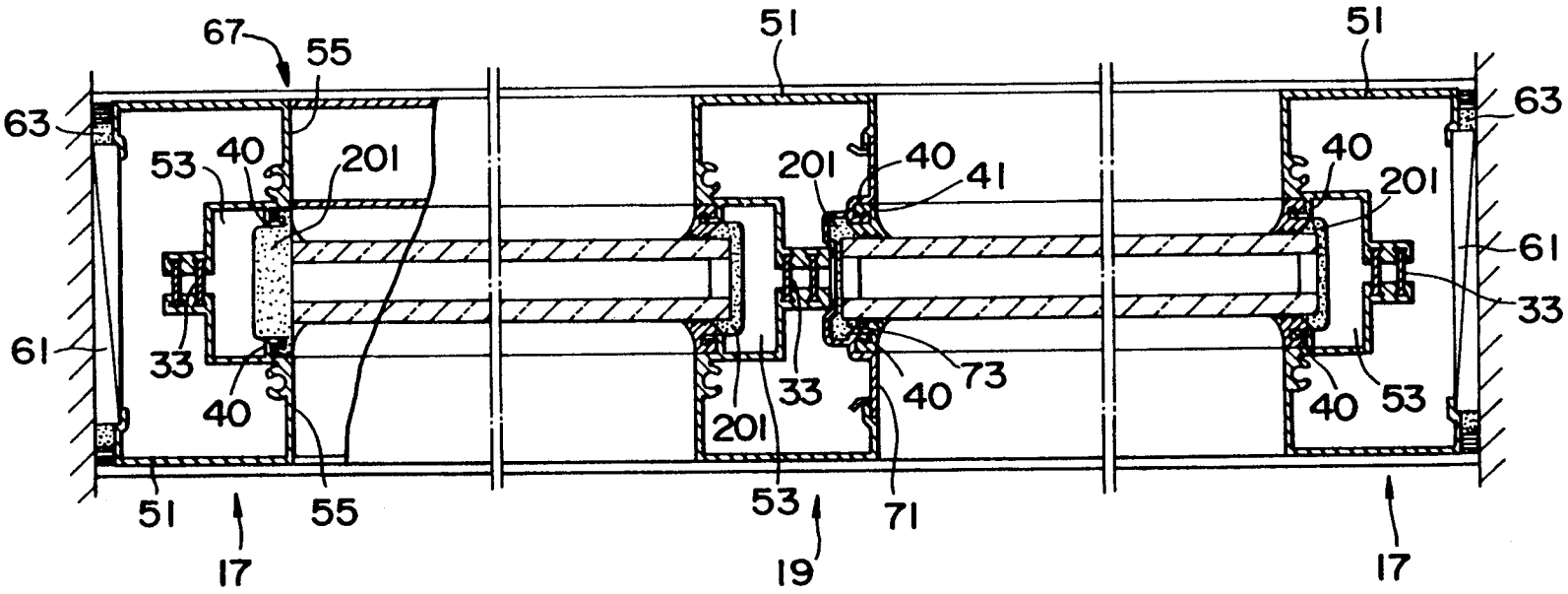
FIG. 3 is a partially fragmented horizontal cross-sectional view taken on line III—III of FIG. 1.

As better shown in FIG. 3, the pair of side vertical frame members 17 are the same channel profiles 51 as the upper horizontal frame member 11. Each side vertical frame member 17 is fastened to a wall jamb (not shown) with a shim 61 and a caulking 63 interposed therebetween. An intermediate vertical frame member 19 is of a two-piece construction and comprises a major piece 51 which is also the same extruded channel profile 51 as the upper horizontal frame member 11 and a filler member 71 snap fitted onto the major piece 51 and having a shallow glazing pocket 73 formed therein. A pair of opposed gasket-fitting channels 40 are formed along the opposed edges of the glazing pocket 73.

An elongated gasket 41 is fitted in each series of gasket-fitting channels 40 surrounding the rectangular openings 20 so as to hold each dual pane glass panel 25 along its periphery.

Figure 7:
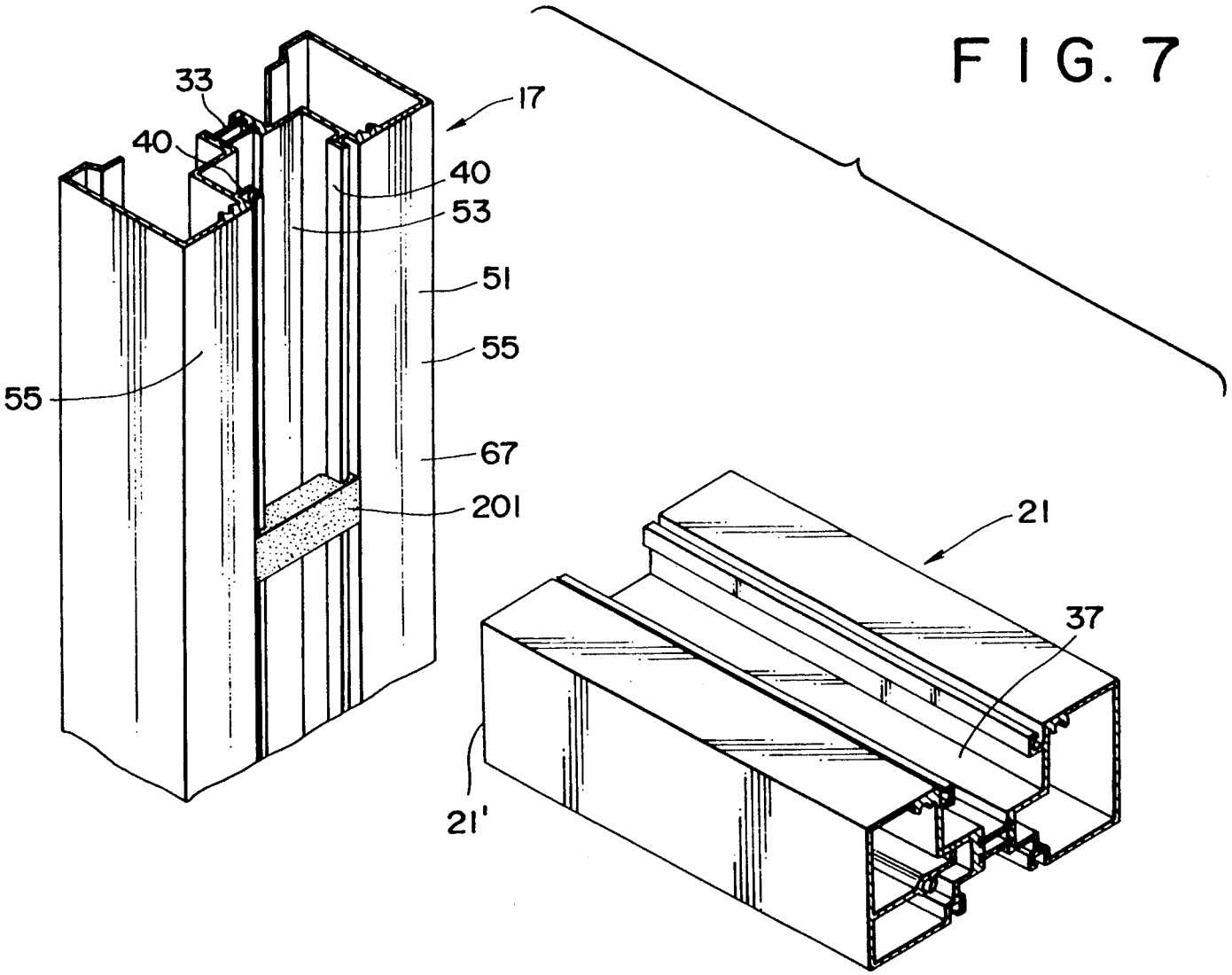
FIG. 7 is a fragmentary perspective view showing the vertical frame member and the horizontal frame member arranged just before assembled.
Figure 8:
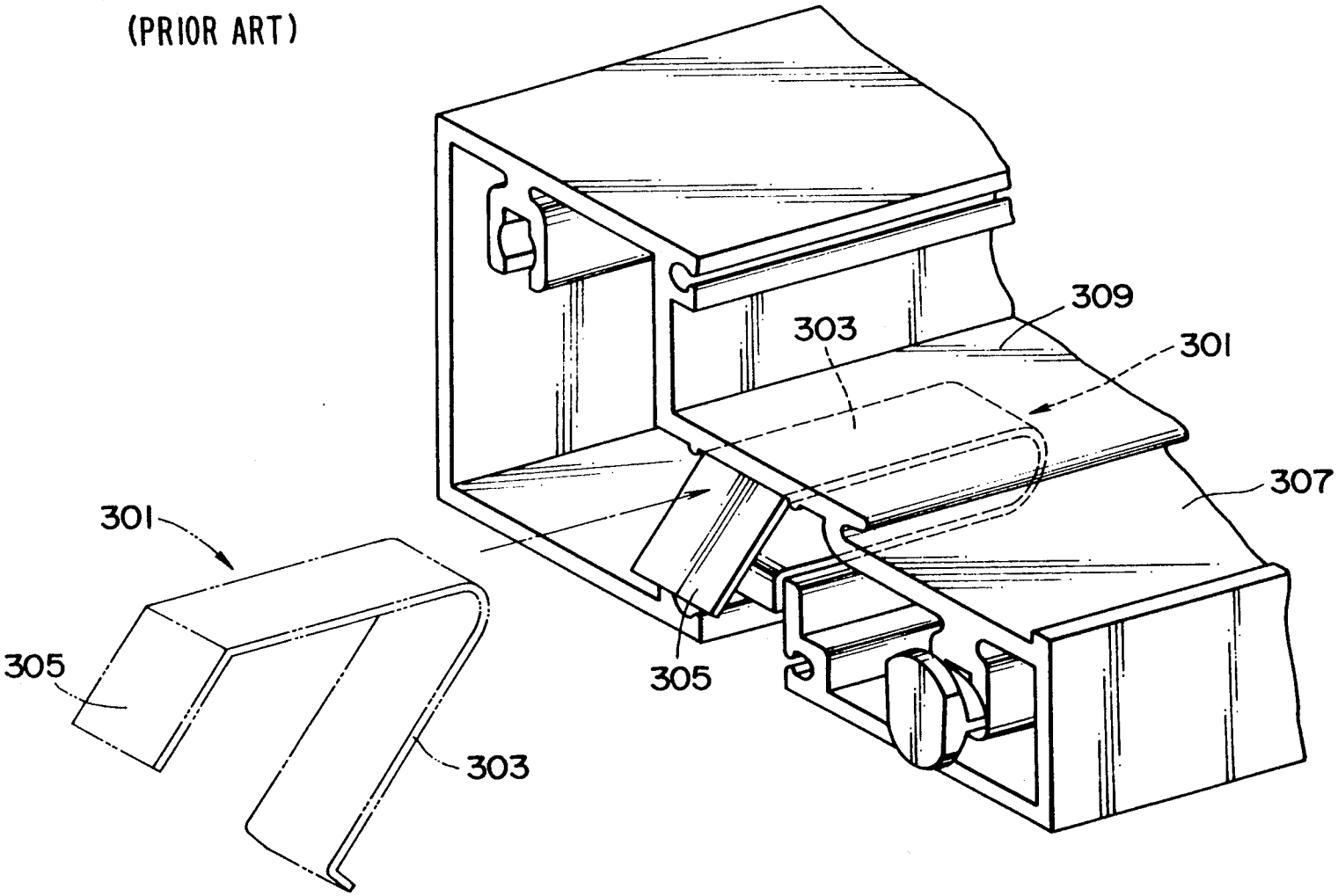
FIG. 8 (PRIOR ART)
FIG. 8 is a perspective view showing how to install a conventional water deflector into a hollow horizontal frame member and how it is postured therein.

As better shown in FIGS. 3 and 7, the side vertical frame member 17 has a glazing pocket 53 on its inner side so as to be defined between a pair of opposed marginal faces 55 thereof. A pair of gasket-fitting channel 40 are formed on the respective opposed inner sides of glazing pocket 53 substantially throughout its inner edges.

Figure 5:
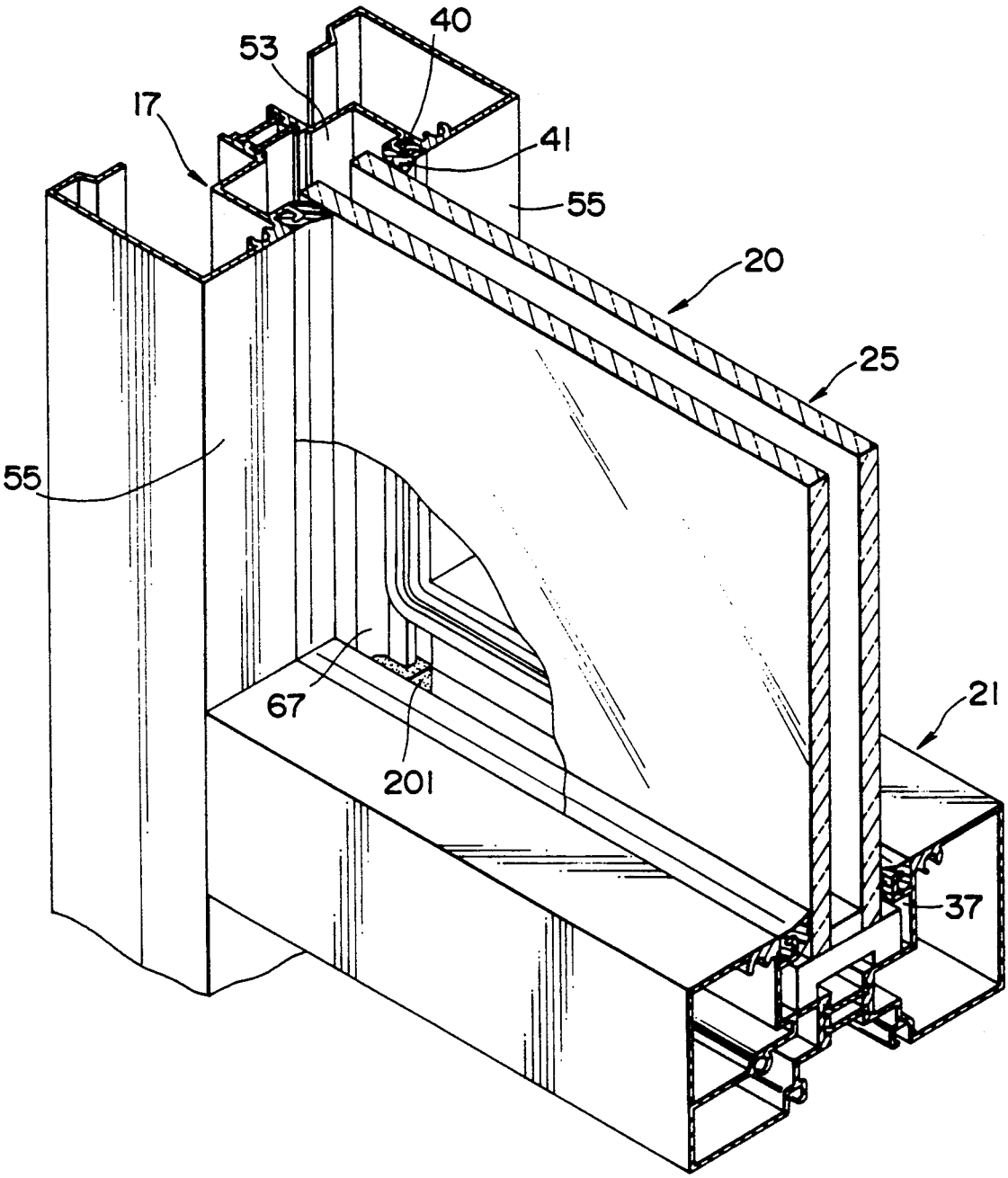
FIG. 5 is a fragmentary, perspective view, partly in cross-section, showing the wall framing at an intersection of a vertical frame member and a horizontal frame member thereof.

As better shown in FIG. 5, the elongated gasket 41 is fitted into the gasket fitting channel 40 of the vertical frame members 17, 19 and horizontal frame members 13, 15, 21 so as to extend around each rectangular opening 20. This means that there is no gasket in the gasket-fitting channel 40 in the intersection 67 where the butt end of the horizontal frame member 21 is joined with the side of vertical frame member 17, 19 and where an improved water deflector 201 described hereinafter goes, taking advantage of the gasket-free channel 40.

Figure 4:
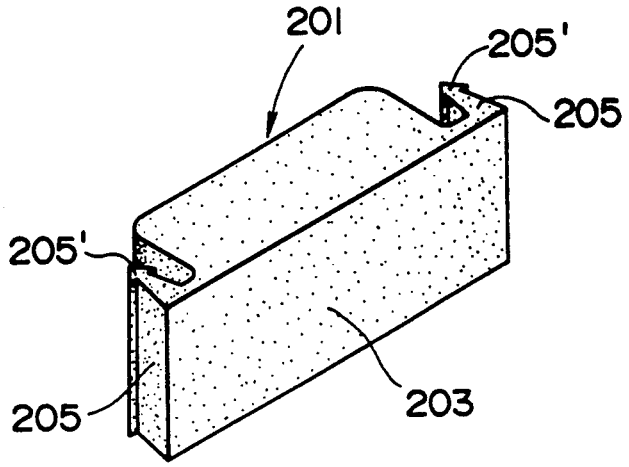
FIG. 4 is a perspective view of the improved water deflector according to the present invention.
Figure 6:
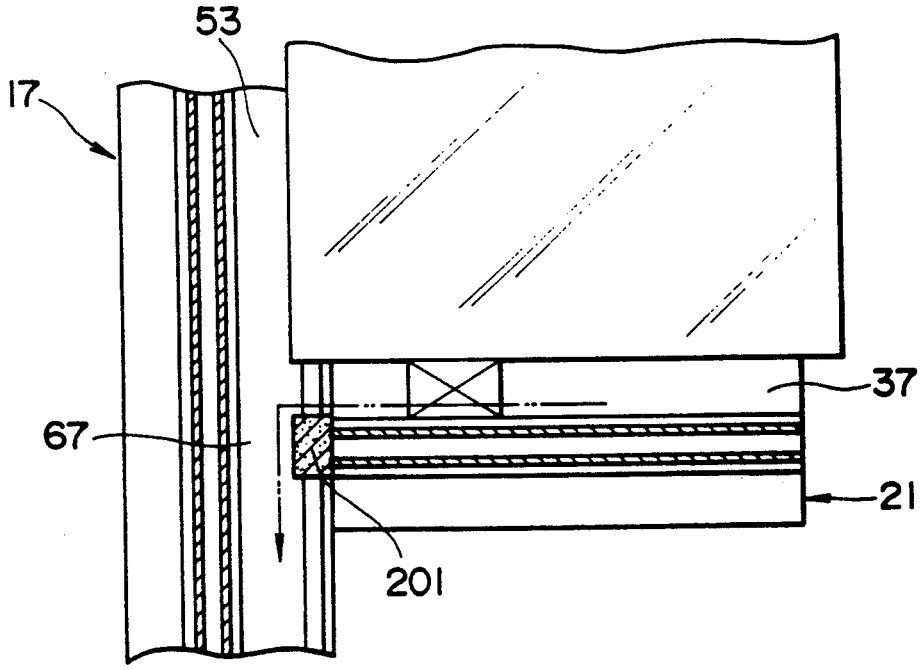
FIG. 6 is a longitudinal cross-sectional view of the intersection of the wall framing shown in FIG. 5.

As better shown in FIG. 4, the water deflector 201 is preferably made of ethylene-propylene terpolymer which is commonly called EPDM in the field and comprises a substantially rectangular block body 201 and a pair of protuberant lateral flanges 205 integrally formed one on each side thereof. Each flange 205 first extends from the rear side of the rectangular block body 203 longitudinally thereof, is then bent forward and terminates in an snap hooks 205'. As better shown in FIG. 7, the water deflector block 201 is fitted into the glazing pocket 53 by causing the snap hooks 205' of the opposed flanges 205 snap fit into the gasket-fitting channels 40, 40 in the gasket-free intersection 67. It is to be noted that the water deflector 201 thus fitted into the glazing pocket 53 extends fully between the opposed marginal faces 55 and is coplanar with the opposed marginal faces 55. As a result, when the butt end 21' of the horizontal frame member 21 is secured to the side of the vertical frame member 17, the water deflector 201 and the opposed marginal faces 55 of the vertical frame member jointly seal off the hollow horizontal frame member 21.

The term "horizontal frame member" is broad enough to include a transom bar, which means that the water deflector 201 can be used at a joint between a transom bar and a vertical frame member.

With the construction set forth hereinabove, as shown in FIG. 4, rain infiltrated into the glazing pocket 37 of the intermediate horizontal frame member 21 flows over the upper end of the water deflector 201 and down the glazing pocket 53 of the vertical frame member 17 and drains through a week hole (not shown) in the bottom of the vertical frame member 17 and never flows back into the interior of the hollow horizontal frame member 21, so that there is no leak into the interior of the building.

Since being coplanar with the opposed marginal faces 55 of the vertical frame member 17, as shown in FIG. 7, the water deflector 201 is quite immune from interfering with the operation of attaching the horizontal frame member 21 to the vertical frame member 17, thus facilitating the assembling operation of the wall framing as a whole.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. An improved wall framing including a vertical frame member having a glazing pocket formed along a side surface of the vertical frame member so as to define a pair of opposed marginal faces therealong, and a hollow horizontal frame member including a glazing pocket formed along a surface of the horizontal frame member, one end of the hollow horizontal frame member joined to a portion of the vertical frame member with the respective glazing pockets of the vertical frame member and the horizontal frame member aligned with each other, wherein the improvement comprises: a water deflector having a rear side and fitted into the vertical frame member glazing pocket at said portion of the vertical frame member so the rear side of the water deflector fully extends between and is coplanar with the pair of opposed marginal faces, so that the water deflector and the opposed marginal faces engagingly seal the one end of the hollow horizontal frame member.

2. The improved wall framing according to claim 1, said vertical frame member glazing pocket including a pair of channels with one channel formed along an edge of each of the opposed marginal faces, the water deflector comprising a block body having a rear side and a pair of protuberant flanges with one flange formed on each side of the block body, each flange extending longitudinally from the rear side of the block body and then bent forward to terminate with a snap hook, the water deflector fitted into the vertical frame member glazing pocket with the snap hooks of the flanges snap fit into the respective channels.

3. The improved wall framing according to claim 2, the water deflector having a single-piece construction.

4. The improved wall framing according to claim 2, the rear side of the water deflector extending fully between and being coplanar with the pair of opposed marginal faces so that the opposed marginal faces and the rear side of the water deflector engagingly seal the one end of the hollow horizontal frame member.

5. The improved wall framing according to claim 1, said water deflector being made of ethylenepropylene terpolymer.

6. A water deflector for engagingly sealing an end of a hollow horizontal frame member joined to a portion of a vertical frame member, wherein the vertical frame member includes a glazing pocket formed along a side surface thereof so as to define a pair of opposed marginal faces and a channel formed along an edge of each of the opposed marginal faces, the water deflector comprising:

a block body having a rear side and a pair of protuberant flanges with one flange formed on each side of the block body, each flange extending longitudinally from the rear side of the block body and then bent forward to terminate with a snap hook, the water deflector configured to be fitted into the vertical frame member glazing pocket at said portion of the vertical frame member with the snap hooks of the flanges snap fit into the respective channels and the rear side fully extending between and coplanar with the pair of opposed marginal faces.

7. The water deflector according to claim 6 having a single-piece construction.

8. The water deflector according to claim 7 being made of ethylene-propylene terpolymer.

* * * * *